US009181496B2

(12) United States Patent
Palmas et al.

(10) Patent No.: US 9,181,496 B2
(45) Date of Patent: Nov. 10, 2015

(54) PROCESS FOR MODIFYING A FLUID CATALYTIC CRACKING UNIT, AND AN APPARATUS RELATING THERETO

(75) Inventors: Paolo Palmas, Des Plaines, IL (US); Richard A. Johnson, II, Algonquin, IL (US); Ronald Gatan, Chicago, IL (US)

(73) Assignee: UOP LLC, Des Plaines, IL (US)

( * ) Notice: Subject to any disclaimer, the term of this patent is extended or adjusted under 35 U.S.C. 154(b) by 882 days.

(21) Appl. No.: 13/428,818

(22) Filed: Mar. 23, 2012

(65) Prior Publication Data

US 2013/0247559 A1 Sep. 26, 2013

(51) Int. Cl.

| | |
|---|---|
| ***C10G 11/18*** | (2006.01) |
| *C10G 11/00* | (2006.01) |
| *C10G 11/14* | (2006.01) |
| *C10G 11/16* | (2006.01) |
| *F01K 25/14* | (2006.01) |

(52) U.S. Cl.

CPC ..... *C10G 11/18* (2013.01); *C10G 11/182* (2013.01); *C10G 11/187* (2013.01); *Y10T 29/49718* (2015.01)

(58) Field of Classification Search

CPC ..... B01D 53/46; B01D 53/48; B01D 53/52; B01D 53/54; B01D 53/58; F01K 25/14; C10G 11/185

See application file for complete search history.

(56) References Cited

U.S. PATENT DOCUMENTS

| | | | | |
|---|---|---|---|---|
| 4,434,044 | A | 2/1984 | Busch et al. | |
| 4,894,141 | A | 1/1990 | Busch et al. | |
| 5,021,144 | A | 6/1991 | Altrichter | |
| 5,716,514 | A * | 2/1998 | Buchanan | 208/113 |
| 7,048,782 | B1 | 5/2006 | Couch et al. | |
| 7,470,412 | B2 * | 12/2008 | Rosen et al. | 423/235 |
| 2002/0178703 | A1 | 12/2002 | Ribera Salcedo | |
| 2011/0110825 | A1 | 5/2011 | Leonard et al. | |

FOREIGN PATENT DOCUMENTS

WO 2008056130 5/2008

OTHER PUBLICATIONS

U.S. Appl. No. 13/018,510, filed Feb. 1, 2011, Entitled "Process for Separating Particulate Solids From a Gas Stream", by Kulprathipanja et al.

Mortenson, "Control of Particulate Emissions From a Fluid Cat Cracker in Los Angeles", American Petroleum Institute Proceedings; Division of Refining 1972, May 1972, Number Prepr N. 38-72, 9-13, pp. 540-543.

* cited by examiner

*Primary Examiner* — Brian McCaig

(57) ABSTRACT

One exemplary embodiment can be a process for modifying a fluid catalytic cracking unit. The process can include adding a carbon monoxide boiler to the fluid catalytic cracking unit to receive a bypassed flue gas stream from a power recovery expander for increasing capacity of the fluid catalytic cracking unit.

19 Claims, 1 Drawing Sheet

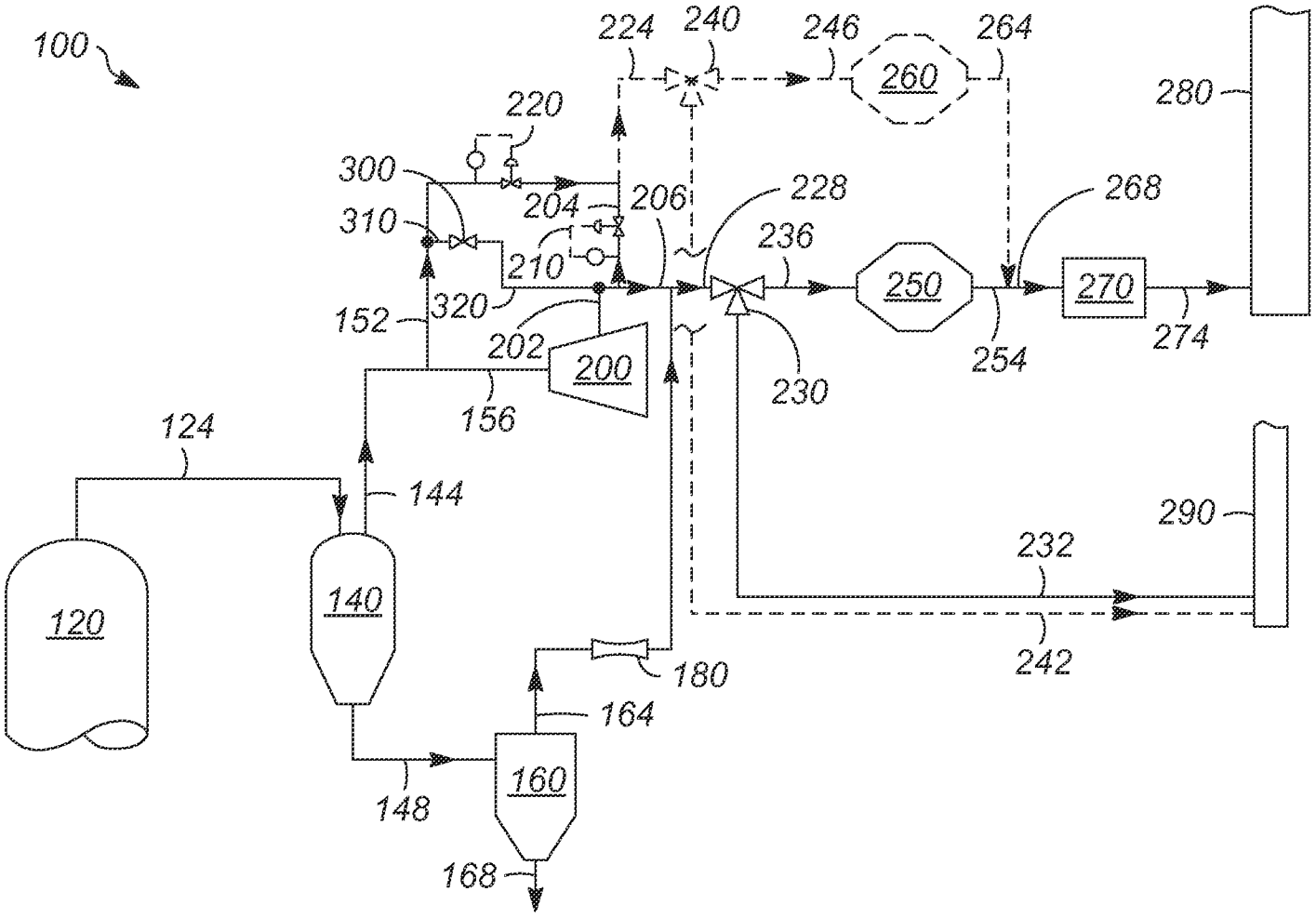
100
120
124
140
144
148
152
156
160
164
168
180
200
202
204
206
210
220
224
228
230
232
236
240
242
246
250
254
260
264
268
270
274
280
290
300
310
320

PROCESS FOR MODIFYING A FLUID CATALYTIC CRACKING UNIT, AND AN APPARATUS RELATING THERETO

FIELD OF THE INVENTION

This invention generally relates to a process for modifying a fluid catalytic cracking unit, and an apparatus relating thereto.

DESCRIPTION OF THE RELATED ART

A fluid catalytic cracking apparatus can have limitations for increasing feed rates due to constraints with discharging regeneration flue gases. Particularly, the capacity of a carbon monoxide boiler may be exceeded by increasing the feed to the fluid catalytic cracking apparatus by generating additional regeneration flue gases. These excessive regeneration gases can exceed the carbon monoxide boiler capacity. Moreover, revamping the regeneration flue gas discharge equipment may be difficult as this equipment is typically the bottle neck of a partial burn fluid catalytic cracking apparatus. Thus, there is a desire to modify the discharge equipment efficiently and effectively to remove this bottleneck to increase production.

SUMMARY OF THE INVENTION

One exemplary embodiment can be a process for modifying a fluid catalytic cracking unit. The process can include adding a carbon monoxide boiler to the fluid catalytic cracking unit to receive a bypassed flue gas stream from a power recovery expander for increasing capacity of the fluid catalytic cracking unit.

Another exemplary embodiment may be an apparatus for treating a flue gas from a regeneration vessel. The apparatus can include a regeneration vessel, an external stage separator in communication with the regeneration vessel, a power recovery expander in communication with the external stage separator, and first and second carbon monoxide boilers in communication with the power recovery expander. The flow control valve may be provided for bypassing a flue gas stream around the first carbon monoxide boiler.

A further exemplary embodiment can be a process for modifying a fluid catalytic cracking unit. The process can include adding a carbon monoxide boiler to the fluid catalytic cracking unit to receive a bypassed flue gas stream from a power recovery expander. Generally, the fluid catalytic cracking unit includes a regeneration vessel providing the flue gas stream, an external stage separator in communication with the regeneration vessel to receive the flue gas stream, the power recovery expander in communication with the external stage separator to receive at least a portion of the flue gas stream, and an existing carbon monoxide boiler in communication with the power recovery expander to receive the at least a portion of the flue gas stream.

The embodiments disclosed herein may provide a parallel carbon monoxide boiler on a power recovery expander bypass line. Typical power recovery units have a bypass around the expander due to limitations in the expander flow rate and for maintenance. The embodiments disclosed herein re-route the expander bypass line to an added carbon monoxide boiler, hence eliminating the bottle neck with the existing carbon monoxide boiler.

DEFINITIONS

As used herein, the term "stream" can include various hydrocarbon molecules, and/or other substances, such as gases, e.g., hydrogen, carbon dioxide, carbon monoxide, and oxygen, or impurities, such as heavy metals, and sulfur and nitrogen compounds. Moreover, a stream can include one or more phases, such as a dispersion. One exemplary stream can include both gas and solids, such as an aerosol. A "flue gas stream" may include one or more of carbon dioxide, carbon monoxide, nitrogen, water, oxygen, and catalyst particles.

As used herein, the terms, e.g., "catalyst particles", "catalyst fines", "particles", "particulates", and "particulate solids" may be used interchangeably.

As used herein, the term "communication" can mean that one vessel or equipment may, directly or indirectly, transfer or receive at least one fluid, such as one or more gases, through a line or a pipe to or from another vessel or equipment.

As depicted, process flow lines in the FIGURES can be referred to interchangeably as, e.g., lines, pipes, feeds, products, effluents, portions, parts, or streams.

BRIEF DESCRIPTION OF THE DRAWING

The FIGURE is a schematic depiction of an exemplary fluid catalytic cracking unit.

DETAILED DESCRIPTION

Referring to the FIGURE, a fluid catalytic cracking (hereinafter may be referred to as "FCC") unit 100 can include a regeneration vessel 120 (only partially depicted), an external stage separator 140, another stage separator 160, a power recovery expander 200, first and second control valves 210 and 220, first and second diverter valves 230 and 240, a first or existing carbon monoxide boiler 250, a second or added carbon monoxide boiler 260, an electrostatic precipitator 270, a stack 280, a bypass stack 290, a valve 300, and lines 310 and 320. Each of the first and second control valves 210 and 220 can include both the valve and flow indicator controller, and the valves 210 and 220 are numbered as such in the FIGURE. Typically, the regeneration vessel 120, and the external stage separator 140 can be any suitable vessel, such as those disclosed in, e.g., U.S. Pat. No. 7,048,782.

The regeneration vessel 120 can receive catalyst from one or more reactor risers to regenerate the catalyst. An exemplary reactor riser is disclosed in, e.g., U.S. Pat. No. 7,048,782. Next, the regeneration vessel 120 may receive an air stream to combust hydrocarbons for providing a regenerated catalyst. After combustion, one or more gases can exit as a flue gas stream 124. The flue gas stream 124 can include carbon monoxide, carbon dioxide, water, oxygen, nitrogen, and catalyst particles.

The external stage separator 140 can house one or more cyclones, and may be referred to as a third stage separator 140 if two stages proceed the third stage separator in the regeneration vessel 120. Typically, gases enter the external stage separator 140 and using centrifugal force, most of the particulate solids pass out the bottom while gases can be removed from the side or top of the external stage separator 140. Generally, larger sized particulates are passed out the bottom through a line 148 and smaller particles are entrained in a flue gas stream 144.

Another stage or fourth separator 160, which may be an underflow filter, can communicate with the external stage separator 140. Generally, the line 148 contains a stream including particulates provided to the another stage separator 160. A relatively particulate free flue gas stream 164 may exit the top of the another stage separator 160, while a line 168 may contain a stream including catalyst particles that may be sent for further processing or disposal. The flue gas stream 164 may pass through a critical flow nozzle 180 prior to being provided downstream of the power recovery expander 200, as discussed further below.

The flue gas stream 144 can be split into a bypass stream 152 and a primary flue gas stream 156. The primary flue gas stream 156 may be provided to the power recovery expander 200 that can generate electricity by passing the hot primary flue gas stream 156 over an expander turbine to generate electricity. The expander turbine can include an expander turbine, a shaft, a gear box, and a generator. One exemplary power recovery expander is disclosed in, e.g., U.S. Pat. No. 7,048,782. Typically, the recovered energy from the flue gas stream 156 may be in the form of electricity or mechanical power to drive other attached equipment. Often, the flue gases exiting the expander have substantial remaining energy for further recovery in the existing carbon monoxide boiler 250. The steam may be generated for refinery or chemical manufacturing plant use. An outlet line 202 from the power recovery expander 200 may be combined with the flue gas stream 164 and pass through a line 228 to the first diverter valve 230. Afterwards, the combined gases may pass through an inlet line 236 to the first carbon monoxide boiler 250.

In one exemplary embodiment, the first carbon monoxide boiler 250 can combust carbon monoxide with added air and fuel to form carbon dioxide. Optionally, indirect heat exchange with boiler feed water may generate high pressure steam. An exemplary first carbon monoxide boiler 250 is disclosed in, e.g., U.S. Pat. No. 4,434,044.

Afterwards, the gases passing through the outlet line 254 can be received at an inlet line 268 of an electrostatic precipitator 270. The electrostatic precipitator 270 can utilize a high-voltage power supply to generate electric forces to charge particles. Particles can be attracted to at least one collector plate and removed by pneumatic hammers, vibrating devices, or a washing liquid. Alternatively, a scrubber may be used instead of the electrostatic precipitator, or both devices may be omitted. Afterward, the gases can pass through an outlet line 274 to a stack 280.

If the primary flue gas stream 144 exceeds the capacity of the power recovery expander 200, excessive flue gases can pass through the bypass line 152 and through the second flow control valve 220. Generally, the valve 300 is closed. Moreover, excessive gases from the outlet line 202 may pass through the first flow control valve 210 via an overflow line 204 and merge with the bypass stream 152 to converge in a line 224. Next, the gases may pass through the second diverter valve 240 to an inlet line 246 of the second carbon monoxide boiler 260. The second carbon monoxide boiler 260 can operate similarly as the carbon monoxide boiler 250, as described above.

Afterwards, the gases may exit an outlet line 264 to merge with the gases in the outlet line 254. The merged gases can pass to the inlet line 268 to the electrostatic precipitator 270, as described above.

During start-up, gases can pass from the regeneration vessel 120, the line 124, the external stage separator 140, and the line 144. Afterwards, gases can pass through the line 156 through the power recovery expander 200 to the first diverter valve 230. Generally, the gases are diverted during start-up to facilitate the safe commissioning of the first carbon monoxide boiler 250. If excessive gases are received by the power recovery expander 200, such gases may be bypassed via the bypass line 152 and through the second flow control valve 220. What is more, if excessive gases are passed through the outlet line 202, the gases may pass through the first flow control valve 210 and be combined with the gases from the bypass line 152 to be combined in the line 224. The first and second control valves 210 and 220 can regulate the flow of the gases based on the capacity of the power recovery expander 200 and the first carbon monoxide boiler 250. During start-up, gases may pass through the second diverter valve 240 through a line 242 to the bypass stack 290.

Once the fluid catalytic cracking unit 100 reaches steady-state, the flue gas stream 124 containing catalyst particles may pass to the external stage separator 140. Larger sized particulates may pass through the line 148 to the another stage separator 160. Catalyst fines or particles may pass through the line 168 and the relatively particulate free flue gas stream 164 can exit the top of the another stage separator 160. Afterwards, the flue gas stream 164 may pass through the critical flow nozzle 180, and the flue gas stream 164 may be combined with the primary flue gas stream 206.

The flue gas stream 144 from the external stage separator 140 can pass as a primary flue gas stream 156 to the power recovery expander 200. A primary flue gas stream 206 from the outlet line 202 may be combined with the flue gas stream 164. The line 228 can receive the combined gases.

Gases exceeding the capacity of the power recovery expander 200 may pass through the bypass line 152 through the second flow control valve 220 to the line 224. Optionally, excessive gases from the outlet line 202 of the power recovery expander 200 may pass through the first flow control valve 210 to the line 224. The gases may pass through the second diverter valve 240 to the inlet line 246 of the second carbon monoxide boiler 260. Gases from the second carbon monoxide boiler 260 may pass through the outlet line 264 and be combined with the gases in the outlet line 254, as hereinafter described.

The gases in the line 228 can be passed through the first diverter valve 230. Next, the gases may pass to the inlet line 236 of the first carbon monoxide boiler 250. After combustion, gases may pass through the outlet line 254 and combined with the gases in the outlet line 264 and be combined in the inlet line 268 to the electrostatic precipitator 270. The gases may exit the precipitator 270 and pass the outlet line 274 to the stack 280.

Often, the fluid catalytic cracking unit 100 may be limited by the capacity of the power recovery expander 200 and/or the existing carbon monoxide boiler 250 with gases exceeding the capacity of the power recovery expander 200 bypassed. The dashed lines in the FIGURE indicate additional equipment that can be added to the existing fluid catalytic cracking unit 100 to remove the bottle-neck created by the power recovery expander 200. The added equipment can include the lines 224, 242, 246, and 264 and the first flow control valve 210, the second diverter valve 240, and the added carbon monoxide boiler 260. Hence, the excessive gases can be treated by the second carbon monoxide boiler 260, and thus, prevent limiting the capacity of the fluid catalytic cracking unit 100.

Thus, an existing fluid catalytic cracking unit 100 may have only a single, existing carbon monoxide boiler 250. Typically, a power recovery expander 200 has an expander bypass line 152 due to capacity limitations or for maintenance on the power recovery expander 200. Even with bypassing the flue gases, the emission of flue gases to the stack 280 may still be limited.

In one exemplary embodiment, the bypass line 152 can divert flue gases from the existing carbon monoxide boiler 250 to an added carbon monoxide boiler 260. The outlet streams of the two boilers 250 and 260 may then be provided to a common electrostatic precipitator 270 or scrubber, and then pass to the stack 280. Alternatively, the precipitator or scrubber may be omitted. In the event of an expander trip, the primary flue gas stream 156, which can normally pass to the power recovery expander 200, can pass through the bypass line 152, the line 310, the valve 300, and the line 320 to the outlet line 202 by triggering the opening of the valve 300. The flow of flue gases through the second control valve 220 can remain substantially unchanged so gas flow may be maintained to both the first and second carbon monoxide boilers 250 and 260.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A process for modifying a fluid catalytic cracking unit, comprising adding a carbon monoxide boiler to the fluid catalytic cracking unit to receive a bypassed flue gas stream from a power recovery expander for increasing capacity of the fluid catalytic cracking unit and adding a diverter valve upstream of the added carbon monoxide boiler.

2. The process according to claim 1, wherein the fluid catalytic cracking unit comprises an existing carbon monoxide boiler that is a first carbon monoxide boiler and the added carbon monoxide boiler is a second carbon monoxide boiler.

3. The process according to claim 2, further comprising adding a flow control valve to the fluid catalytic cracking unit for bypassing flue gas around the first carbon monoxide boiler.

4. The process according to claim 3, wherein the fluid catalytic cracking unit further comprises a regeneration vessel in communication with the first carbon monoxide boiler.

5. The process according to claim 4, wherein the fluid catalytic cracking unit further comprises an external stage separator and another stage separator in communication with the regeneration vessel wherein the external stage separator and the another stage separator remove catalytic particles from the flue gas.

6. The process according to claim 5, wherein a first portion of the flue gas is provided to a power recovery expander and a second portion of the flue gas is bypassed and provided to the second carbon monoxide boiler.

7. The process according to claim 5, further comprising adding another flow control valve between the external stage separator and the second carbon monoxide boiler.

8. The process according to claim 5, wherein the fluid catalytic cracking unit further comprises an electrostatic precipitator in communication with the first and second carbon monoxide boilers.

9. The process according to claim 8, wherein the fluid catalytic cracking unit further comprises a stack in communication with the electrostatic precipitator.

10. A process for modifying a fluid catalytic cracking unit, comprising adding a carbon monoxide boiler to the fluid catalytic cracking unit on a power recovery expander bypass line to receive a bypassed flue gas stream that bypasses around a power recovery expander for increasing capacity of the fluid catalytic cracking unit.

11. The process according to claim 10, further comprising adding a diverter valve upstream of the added carbon monoxide boiler.

12. The process according to claim 11, wherein the fluid catalytic cracking unit comprises an existing carbon monoxide boiler that is a first carbon monoxide boiler and the added carbon monoxide boiler is a second carbon monoxide boiler.

13. The process according to claim 12, further comprising adding a flow control valve to the fluid catalytic cracking unit for bypassing flue gas around the first carbon monoxide boiler.

14. The process according to claim 13, wherein the fluid catalytic cracking unit further comprises a regeneration vessel in communication with the first carbon monoxide boiler.

15. The process according to claim 14, wherein the fluid catalytic cracking unit further comprises an external stage separator and another stage separator in communication with the regeneration vessel wherein the external stage separator and the another stage separator remove catalytic particles from the flue gas.

16. The process according to claim 15, wherein a first portion of the flue gas is provided to a power recovery expander and a second portion of the flue gas is bypassed and provided to the second carbon monoxide boiler.

17. A process for modifying a fluid catalytic cracking unit, comprising adding a carbon monoxide boiler to the fluid catalytic cracking unit, wherein a first portion of the flue gas is provided to a power recovery expander and a second portion of the flue gas is bypassed around the power recovery expander and provided to the carbon monoxide boiler receiving the bypassed second portion of the flue gas stream for increasing capacity of the fluid catalytic cracking unit.

18. The process according to claim 17, further comprising adding a diverter valve upstream of the added carbon monoxide boiler.

19. The process according to claim 17, wherein the fluid catalytic cracking unit comprises an existing carbon monoxide boiler that is a first carbon monoxide boiler and the added carbon monoxide boiler is a second carbon monoxide boiler.

* * * * *